US011736889B2

(12) United States Patent
Sunder et al.

(10) Patent No.: US 11,736,889 B2
(45) Date of Patent: Aug. 22, 2023

(54) PERSONALIZED AND INTEGRATED VIRTUAL STUDIO

(71) Applicant: EmbodyVR, Inc., San Mateo, CA (US)

(72) Inventors: Kaushik Sunder, Mountain View, CA (US); Kieran Coulter, San Mateo, CA (US); Kapil Jain, Redwood City, CA (US)

(73) Assignee: EMBODYVR, INC., San Mateo, CA (US)

( * ) Notice: Subject to any disclaimer, the term of this patent is extended or adjusted under 35 U.S.C. 154(b) by 0 days.

(21) Appl. No.: 17/207,659

(22) Filed: Mar. 20, 2021

(65) Prior Publication Data

US 2021/0297806 A1 Sep. 23, 2021

Related U.S. Application Data

(60) Provisional application No. 62/992,737, filed on Mar. 20, 2020.

(51) Int. Cl.
*H04R 29/00* (2006.01)
*H04S 7/00* (2006.01)

(52) U.S. Cl.
CPC ..... *H04S 7/308* (2013.01); *H04S 7/302* (2013.01); *H04S 2400/01* (2013.01); *H04S 2420/01* (2013.01)

(58) Field of Classification Search
CPC ..... H04S 7/308; H04S 7/302; H04S 2400/01; H04S 2420/01
USPC ..... 381/58, 59
See application file for complete search history.

(56) References Cited

U.S. PATENT DOCUMENTS

| | | | | |
|---|---|---|---|---|
| 2011/0064235 | A1* | 3/2011 | Allston | G10L 21/00 381/63 |
| 2021/0211829 | A1* | 7/2021 | Riggs | G06F 3/012 |
| 2021/0227342 | A1* | 7/2021 | Norris | H04M 3/568 |
| 2021/0258712 | A1* | 8/2021 | Lyren | H04R 5/033 |
| 2022/0030373 | A1* | 1/2022 | Mehta | H04S 7/30 |

* cited by examiner

*Primary Examiner* — Ammar T Hamid

(57) ABSTRACT

Methods, systems, and program products for generating a virtual studio are disclosed. In one embodiment a method includes processing image information for at least one pinna of a user to generate a head-related transfer function (HRTF) profile of the user. A studio model that includes a studio-specific acoustic profile is accessed such as by a virtual studio client application executing on a laptop. An audio configuration of the studio model is selected based on the studio-specific acoustic profile. An audio media source is activated and the audio configuration is applied in combination with the HRTF profile of the user to audio generated by the audio media source.

17 Claims, 4 Drawing Sheets

PERSONALIZED AND INTEGRATED VIRTUAL STUDIO

BACKGROUND

The disclosure generally relates to audio systems and to methods and systems for With the increasing popularity of earphones and headphones, mixing and auditioning music over headphones has become an integral aspect of music creation and distribution. Sound engineers, musicians, and producers typically mix and master their music on their high-end speakers in their respective studios. The end listeners, however, mostly listen to this music on earphones or headphones. This also leads to some unnatural coloration and spatial imaging of the original sound. This presents an important need for auditioning and mixing on headphones and ensuring the high-fidelity of the sound on headphones as well. Currently available virtual studio plugins use head-related transfer functions (HRTFs) along with generic room measurements that may cause tonal coloration and unnatural listening experience.

BRIEF DESCRIPTION OF THE DRAWINGS

Aspects of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. In some instances, well-known instruction instances, protocols, structures and techniques have not been shown in detail in order not to obfuscate the description.

Example Illustrations

The embodiments disclosed and described herein provide methods, systems, and subsystems for implementing a virtual studio. The virtual studio may be implemented, at least in part, by a virtual studio plugin executing on a personal computing and communications device such as a mobile phone, tablet, lap top computer, etc. The virtual studio plugin may be configured as a personalized virtual studio plugin include program instructions and data configured to provide a virtualized integrated studio experience for users such as sound engineers, musicians, and general public listeners. The disclosed embodiments include systems and methods that accurately reproduce various aspects of a variety of selectable studio models. For example, characteristics of the speakers and ambient audio environment in the studio are replicated as well as headphone characteristics. Disclosed embodiments further replicate the end listener characteristics by modeling the personalized spatial audio profile (e.g., HRTFs) of the listener. Disclosed embodiments combine these aspects to deliver an immersive experience to listeners that activate a plugin having built-in acoustic information of multiple audio studios.

Figure 1:
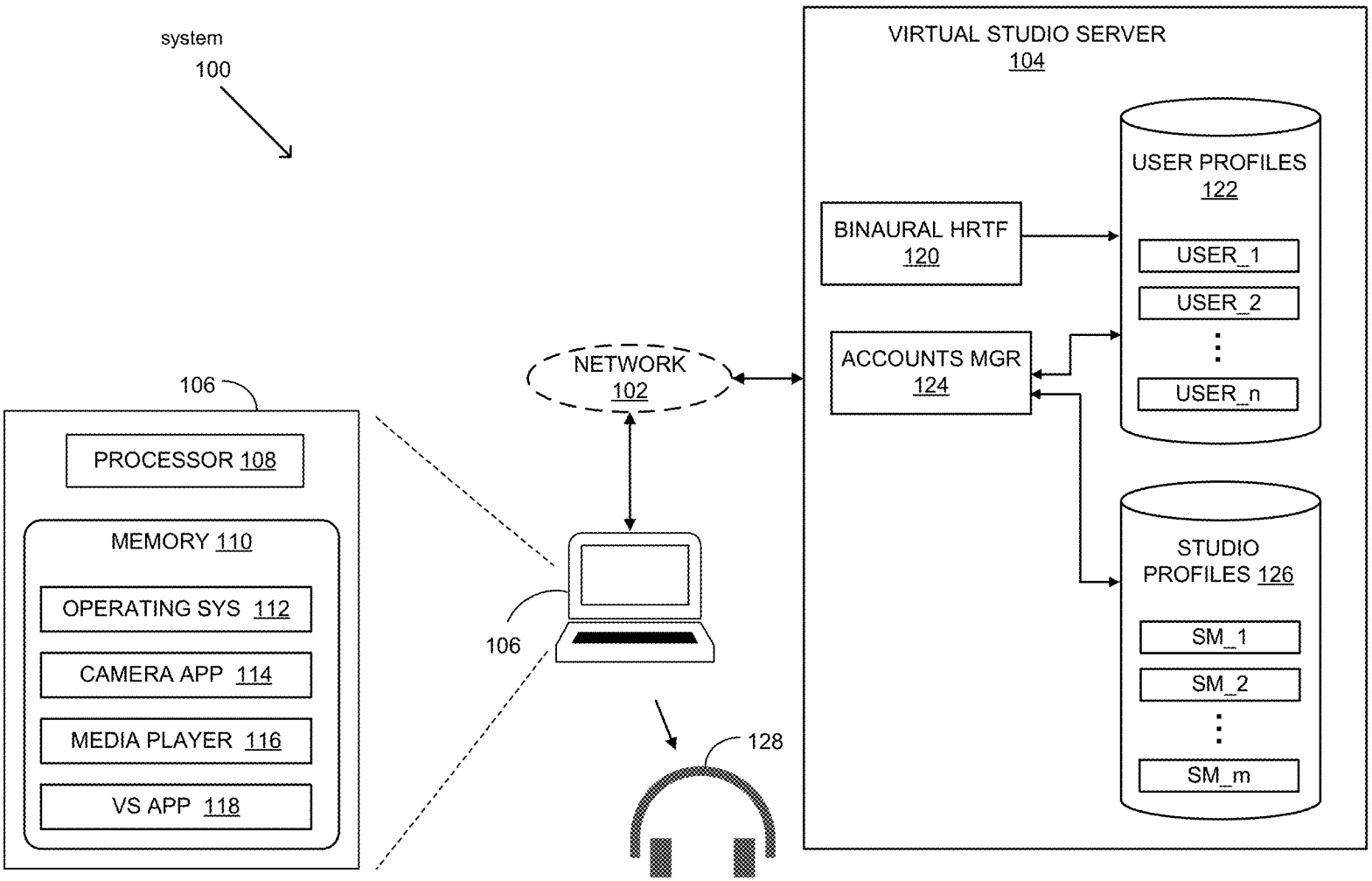
FIG. 1 is a high-level diagram of a system configured to implement a virtual studio plugin in accordance with some embodiments.

FIG. 1 is a high-level diagram depicting systems and devices that are included in or may interact with a virtual studio system 100 in accordance with an embodiment. Virtual studio system 100 includes a network 102 that provides connectivity over which a virtual studio (VS) server 104 communicates with a laptop computer device (laptop) 106. The connectivity may be established by multiple subnetworks and different types of network components, connection media and protocols, and carrier services such as fiber optic cables, telephone lines, Ethernet 802, and Internet protocols. In one aspect, network 102 provides communication infrastructure and media between laptop 106 and VS server 104 to enable laptop 106 to request and obtain software application and update downloads from VS server 104.

In alternate embodiments, laptop 106 may be a personal computer or a mobile device such as a smartphone other type of highly integrated portable device having network connectivity via a network interface. Alternative embodiments may comprise a tablet or other suitably configured computer device having connectivity via network 102 to VS server 104 as well as the functionality described herein for laptop 106. In addition to a network interface, laptop 106 includes a processor 108 and an associated system memory 110 that stores data and system and application software including applications such as a camera application 114, a media player application 116, and a VS application 118. Processor 108 and memory 110 provide information processing capability necessary for network communications and furthermore to enable laptop 106 to perform other information handling tasks related to, incidental to, or unrelated to the methods described herein. An operating system (OS) 112 is maintained within system memory 110. OS 112 may be a flexible, multi-purpose OS such as the Android OS found in smartphones and may generally comprises code for managing and providing services to hardware and software components within laptop 106 to enable program execution.

As explained in further detail with reference to FIG. 3, laptop 106 may include hardware, firmware, and software components configured individually and/or in combination with components in VS server 104 to generate a virtualized studio environment. In some embodiments, generating the virtualized studio environment entails combining studio-specific acoustic characteristics with user-specific aural characteristics. The studio-specific characteristics may include acoustic source information such as information characterizing amplifiers, filters, and speakers that are embodied as acoustic model parameters for a particular studio. The user-specific aural characteristics may include HRTF information for a user that translates physical attributes of a user, such as ear pinna shape, into acoustic transmission information. In some embodiments, generating the virtualized studio environment entails combining studio-specific acoustic characteristics, the user-specific aural characteristics, and a particular audio recording such as a music recording.

VS server 104 includes a binaural HRTF processor 120 that is configured to generate and record user-specific aural information. Binaural HRTF processor 120 may include hardware and software components such as program instructions and data configured to implement an anatomical transfer function that generates modeled responses that characterize how an ear receives sound from a point in space. Binaural HRTF processor 120 is configured to receive and process image information from a client device such as laptop 106 using a coded HRTF to generate the aural information from a user corresponding to the image information. For example, a user may activate camera application to record image information such as individual photographs and/or video of one or more of the user's ears and other portions of the user's head.

In some embodiments, the user may record such information as part of a virtual studio registration process in which VS server 104 requests image input information. The information generated by applying the coded HRTF may be binaural information that may be recorded as a binaural profile for a given user. In some embodiments, binaural HRTF processor 120 is configured to store records that associate user aural information with respective user accounts. As shown in FIG. 1, binaural HRTF processor 120 stores the user aural information within a user profiles database 122 that maintains records USER_1-USER_n for n clients/users. Each of records USER_1-USER_n includes respective user-specific aural information (e.g., binaural information) and also includes pointer or other indices types to associate the user aural information with user account information. The user account information may include, for instance, access control information indicating one or more studio models/profiles that the user may access and utilize.

To further support generating user accounts and server provisioning to the accounts, VS server 104 further includes an account manager 124 that generates and updates user profiles database 122 and a studio profiles database 126. Account manager 124 comprises any combination of programmable hardware and software configured to access, retrieve, and process user aural information and user account information within user profiles database 122. Account manager 124 is further configured to access, retrieve, and process studio profile information recorded within studio profiles database 126. As shown in FIG. 1, account manager 124 or some other component within VS server 104 stores studio model information within a studio profiles database 126 that maintains records SM_1-SM_m for m audio studios. Each of records SM_1-SM_m includes respective studio-specific acoustic information (e.g., acoustic source and acoustic ambience).

In one aspect, the information collected and stored by VS server 104 and recorded within user profiles 122 and studio profiles 126 may be accessed by VS application 118 via client requests from laptop 106. For instance, VS application 118 may send a request for an acoustic profile of a particular studio and in response VS server 104 may download the acoustic profile to laptop 106. In response, accounts manager 124, in cooperation with binaural HRTF processor 120, may utilize client/user and application identifiers (IDs) as keys to locate and retrieve account option such as currently available studio model profiles, contained in or otherwise pointed to by the corresponding records.

As described in further detail with reference to FIGS. 2 and 3, VS application 118 is configured to process an audio signal, such as a recorded music signal, using the binaural HRTF information in combination with the studio-specific acoustic profile. For example, the studio profile information and user binaural information may be applied by VS application 118 during playing of a recorded audio track such as by media player 116 as may be activated by the user. In this manner the audio signal sourced by the media player is processed by VS application 118 using both the studio profile and user aural information to generate a modified audio signal that is transmitted to speakers within user listening device 128. Typically, the speakers comprise electro-acoustic transducer devices that translate the electrical signal corresponding to the modified audio to airborne sound waves that may be perceived by a user. In some embodiments VS application 118 is a standalone software application that may be configured to access and locally store information from either user profiles database 122 and/or studio profiles database 126. In some embodiments, VS application 118 may be configured as a plugin that operates in conjunction with a host application such as a media player (e.g., media player 116).

Figure 2:
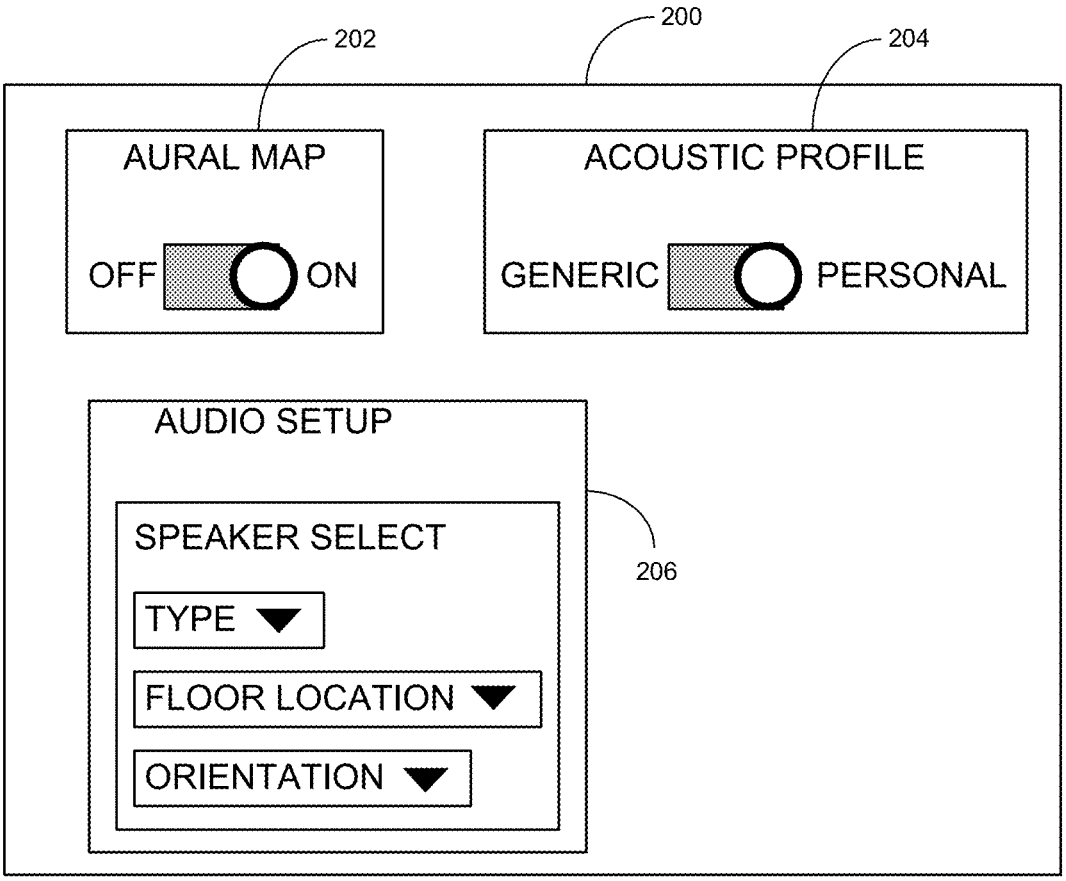
FIG. 2 is a block diagram illustrating a user interface for implementing a virtual studio in accordance with some embodiments.

FIG. 2 is a block diagram illustrating a user interface (UI) 200 for implementing a virtual studio in accordance with some embodiments. User interface 200 may be an interface generated by a VS application such as VS application 118 either as a standalone software application or as a plug supporting a host application such as a media player. UI 200 is displayed on a display device such as on a laptop and is generated using program instructions within a VS application. UI 200 includes objects that enable a user to select, setup, and modify an audio configuration of a studio model that the user selected using the VS application. For example, UI 200 includes an aural map object 202 that includes a selectable widget by which the user may activate/enable or deactivate/disable user aural information configured as an aural map. UI 200 further includes an acoustic profile object 204 that includes a selectable widget by which the user may select either a default or generic acoustic profile for the selected studio model or a user-modifiable acoustic profile of the studio model.

UI 200 also includes an audio setup object 206 that is enabled with the selection of the user-modifiable acoustic profile within object 204. Audio setup object 206 includes three drop-down menus TYPE, FLOOR LOCATION, and ORIENTATION. The TYPE drop-down menu provides a user with a list of individually selectable options for audio speaker type to be included in the acoustic profile. Example of audio speaker type may be audio range category (e.g., tweeter, mid-range, woofer, sub-woofer) and/or other physically defined categorization. The FLOOR LOCATION drop-down menu provides a user with a list of individually selectable options for identifiable locations for one or more selected speakers within the studio based on the location information provided in the selected studio model/profile. The selected location option may be categorical such as specifying a distance from listener range. The ORIENTATION drop-down menu provides a user with a list of individually selectable options for orientations of the selected speakers within the studio based on the orientation information provided in the selected studio model/profile. The selected orientation option may be categorical such as specifying ranges of offset angles from a listener position.

Figure 3:
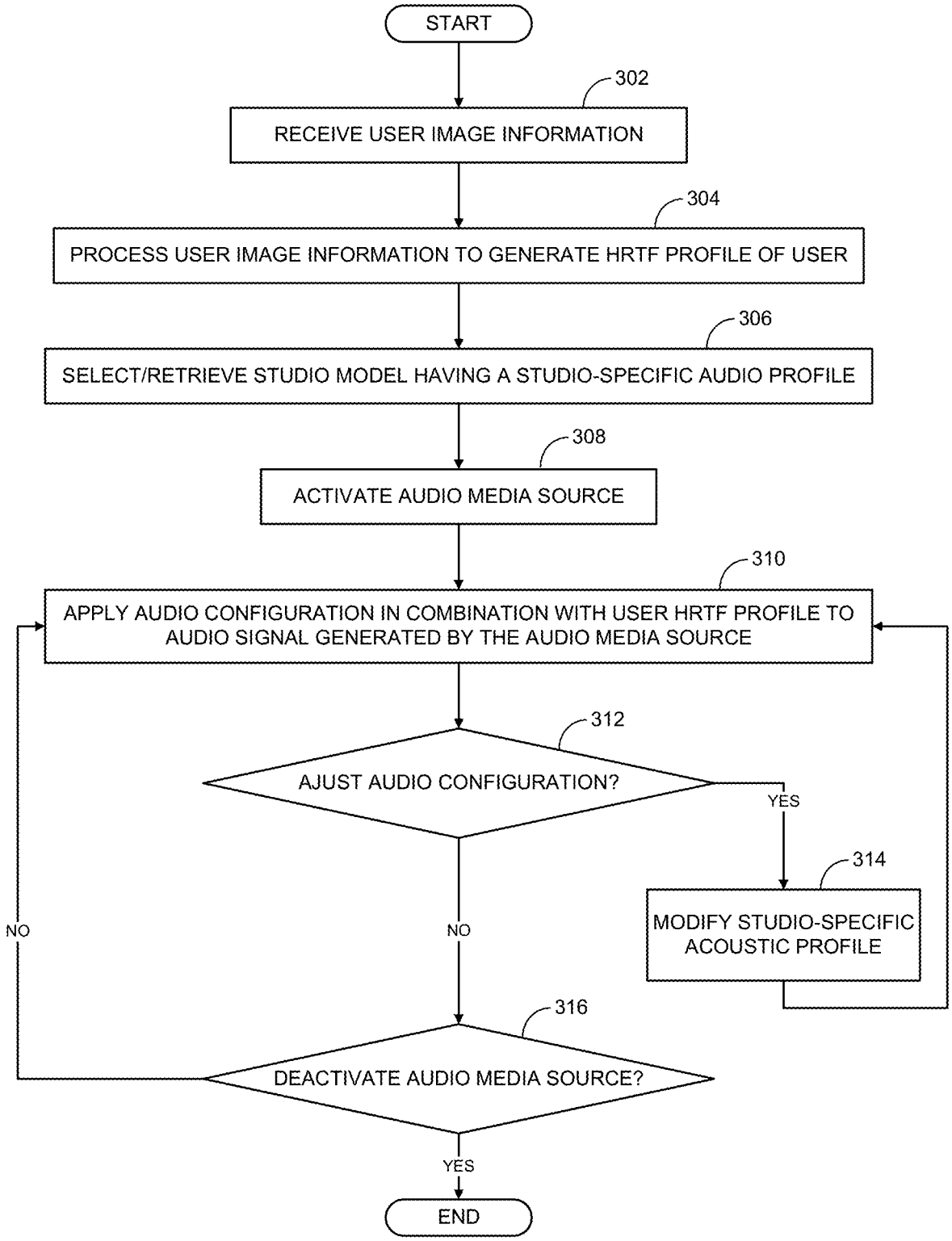
FIG. 3 is a flow diagram illustrating operations and functions for implementing a virtualized studio system in accordance with some embodiments.

FIG. 3 is a flow diagram illustrating operations and functions for implementing a virtualized studio system in accordance with some embodiments. The operations and functions depicted and described with reference to FIG. 3 may be implemented by system, sub-systems, and components depicted in FIGS. 1 and 2. The process begins as shown at block 302 with a VS processing platform such as a VS server receiving user image information. The user image information may be generated by operation of a laptop camera including the camera recording application. The user image information may comprise one or more individual photograph images of at least one ear of a user, such as may be obtained by a user taking a "selfie" as directed by a VS application loaded and executing on the laptop.

At block 304, the host VS platform processes the user image information to generate aural information associated with the user. In some embodiments in which the user image information includes image information for both pinnae of the user's ears, the aural profile may be a binaural HRTF profile of the user. The host VS platform may be configured to store studio information including acoustic information for each of multiple studios. The acoustic information may be recorded as a profile for a given studio and include acoustic source and acoustic ambience information. At block 306, the user selects via the client VS application a studio model that includes a studio-specific acoustic profile. The studio-specific profiled may be download to the client laptop and accessed by the client VS application. The acoustic profile initially retrieved by the client may include a full set of options such as acoustic source and acoustic ambience options. The acoustic source options may include selectable numbers and types of audio speakers. The acoustic ambience options may include selectable and adjustable acoustic reflection and acoustic absorption barriers that are physically characteristic of the studio associated with the studio model.

At block 308, a locally stored or streamed media source is activated such as by user activation of a media player on the laptop hosting the client VS application. For example, a media player application may be selected and activated. Within the media player window, the user may select a particular recorded audio track to be played. In response, the client VS application (e.g., a plugin) may receive an audio signal from the media player and process the audio signal using both the user aural information (e.g., a binaural HRTF) and an audio configuration based on the studio-specific acoustic profile (block 310). The audio configuration is determined by the selections of studio profile source and ambience options to transform audio signal to conform to a substantially similar source applied within the physical studio and perceived by the particular user associated with the aural information.

As the user listens to the modified audio signal on a listening device such as a speaker headset, the user may perceive a need to adjust the audio configuration (inquiry block 312). At block 314, the audio configuration may be adjusted such as via the UI controls depicted in FIG. 2. For instance, the audio configuration may be adjusted by adding or removing acoustic sources and/or by modifying the position or orientation of the audio source. In addition, the audio configuration may be adjusted by adjusting a control parameter associated with acoustic reflection and absorption information to modify an acoustic reflection and/or absorption value. The virtualized playing of the recorded audio continues (return to block 310) until the media player is deactivated at block 316.

Figure 4:
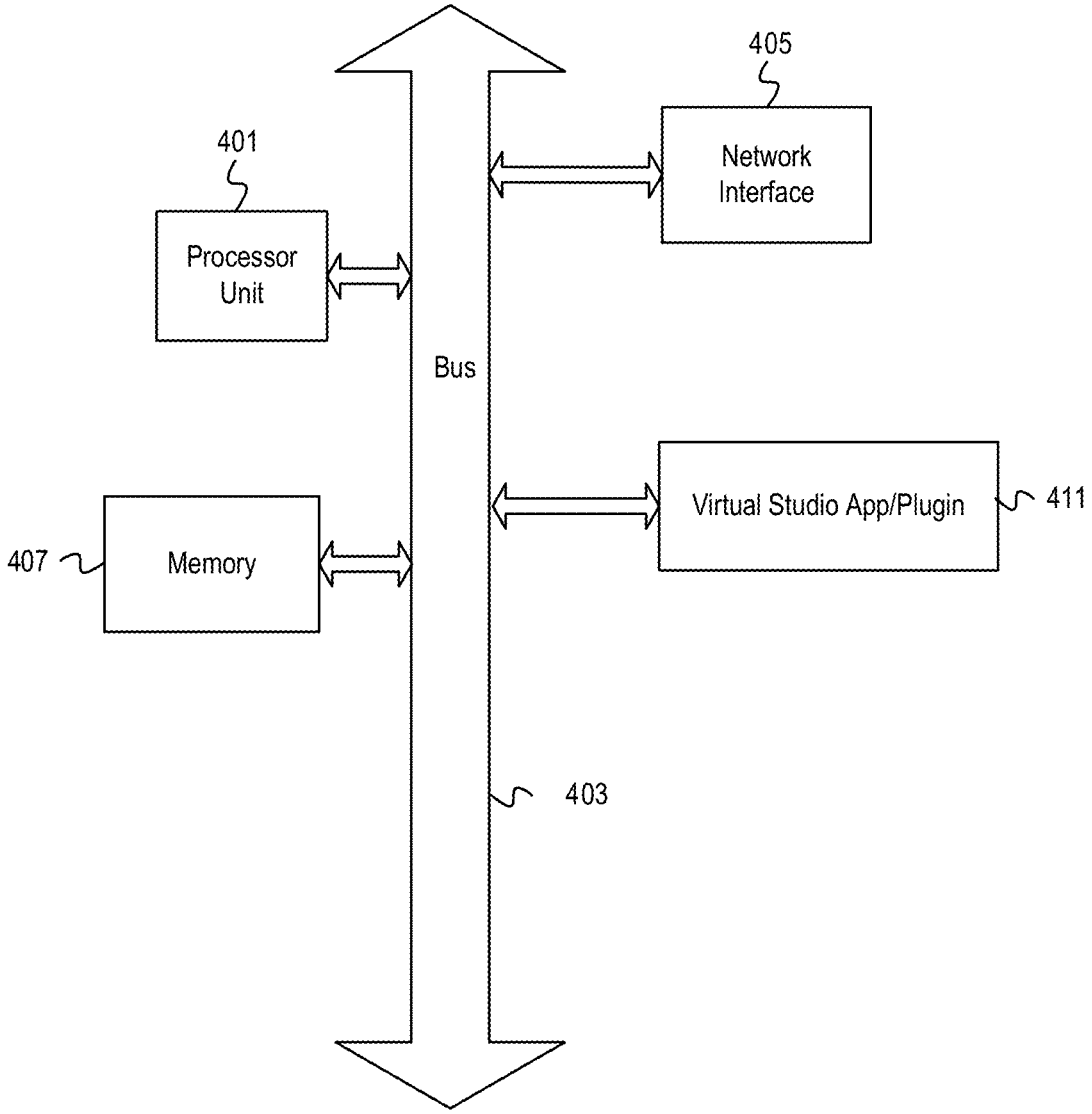
FIG. 4 is a computer system that may be utilized to implement studio virtualization in accordance with some embodiments.

FIG. 4 is a computer system that may be utilized to implement studio virtualization in accordance with some embodiments. The computer system includes a processor unit 401 (possibly including multiple processors, multiple cores, multiple nodes, and/or implementing multi-threading, etc.). The computer system includes memory 407. The memory 407 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 403 (e.g., PCI, ISA, PCI-Express, HyperTransport® bus, InfiniBand® bus, NuBus, etc.) and a network interface 405 (e.g., a Fiber Channel interface, an Ethernet interface, an internet small computer system interface, SONET interface, wireless interface, etc.). The system also includes a VS application 411. The VS application 411 provides program structures for implementing the operations and functions depicted and described with reference to FIGS. 1-3. Any one of the previously described functionalities may be partially (or entirely) implemented in hardware and/or on the processor unit 401. For example, the functionality may be implemented with an application specific integrated circuit, in logic implemented in the processor unit 401, in a co-processor on a peripheral device or card, etc. Further, realizations may include fewer or additional components not illustrated in FIG. 4 (e.g., video cards, audio cards, additional network interfaces, peripheral devices, etc.). The processor unit 401 and the network interface 405 are coupled to the bus 403. Although illustrated as being coupled to the bus 403, the memory 407 may be coupled to the processor unit 401.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

The invention claimed is:

1. A method for generating a virtual studio comprising:

processing image information for at least one pinna of a user to generate a head-related transfer function (HRTF) profile of the user;

accessing a studio model that includes a studio-specific acoustic profile;

selecting an audio configuration of the studio model based on the studio-specific acoustic profile;

activating an audio media source; and applying the audio configuration in combination with the HRTF profile of the user to audio generated by the audio media source;

wherein said applying the audio configuration in combination with the HRTF profile of the user to audio generated by the audio media source comprises:

activating a recording within the audio media source; and adjusting audio of the recording using the studio-specific audio profile.

2. The method of claim 1, further comprising generating one or more studio models wherein each of the one or more studio models includes an acoustic profile comprising acoustic source information and acoustic ambience information.

3. The method of claim 2, wherein the acoustic profile includes acoustic source information that includes types of acoustic sources.

4. The method of claim 3, further comprising modifying the studio-specific acoustic profile by adding or removing acoustic sources from the acoustic profile.

5. The method of claim 2, wherein the acoustic profile includes acoustic ambience information that includes positioning of acoustic sources and further includes acoustic reflection and absorption information.

6. The method of claim 5, wherein the acoustic reflection and absorption information includes at least one acoustic reflection value and at least one acoustic absorption value, said method further comprising adjusting a control parameter associated with the acoustic reflection and absorption information to modify the acoustic reflection value or the acoustic absorption value.

7. The method of claim 1, further comprising receiving via upload the image information for the at least one pinna of the user.

8. The method of claim 1, wherein processing the image information includes receiving image information for both pinnae of the user, and wherein processing image information comprises processing the image information for both pinnae of the user to generate a binaural HRTF profile of the user.

9. The method of claim 8, wherein applying the audio configuration in combination with the HRTF profile of the user comprises applying the binaural HRTF profile of the user to a studio-specific audio profile.

10. A non-transitory, computer-readable medium having instructions stored thereon that are executable by a computing device to perform operations comprising:

processing image information for at least one pinna of a user to generate a head-related transfer function (HRTF) profile of the user;

accessing a studio model that includes a studio-specific acoustic profile;

selecting an audio configuration of the studio model based on the studio-specific acoustic profile;

activating an audio media source; and applying the audio configuration in combination with the HRTF profile of the user to audio generated by the audio media source;

wherein processing the image information includes receiving image information for both pinnae of the user, and wherein processing image information comprises processing the image information for both pinnae of the user to generate a binaural HRTF profile of the user; and wherein applying the audio configuration in combination with the HRTF profile of the user comprises applying the binaural HRTF profile of the user to a studio-specific audio profile.

11. The computer-readable medium of claim 10, further comprising generating one or more studio models wherein each of the one or more studio models includes an acoustic profile comprising acoustic source information and acoustic ambience information.

12. The computer-readable medium of claim 11, wherein the acoustic profile includes acoustic source information that includes types of acoustic sources.

13. The computer-readable medium of claim 12, further comprising modifying the studio-specific acoustic profile by adding or removing acoustic sources from the acoustic profile.

14. The computer-readable medium of claim 11, wherein the acoustic profile includes acoustic ambience information that includes positioning of acoustic sources and further includes acoustic reflection and absorption information.

15. The computer-readable medium of claim 14, wherein the acoustic reflection and absorption information includes at least one acoustic reflection value and at least one acoustic absorption value, said method further comprising adjusting a control parameter associated with the acoustic reflection and absorption information to modify the acoustic reflection value or the acoustic absorption value.

16. The computer-readable medium of claim 10, further comprising receiving via upload the image information for the at least one pinna of the user.

17. The computer-readable medium of claim 10, wherein said applying the audio configuration in combination with the HRTF profile of the user to audio generated by the audio media source comprises:

activating a recording within the audio media source; and adjusting audio of the recording using the studio-specific audio profile.

* * * * *